US007745386B2

(12) United States Patent
King et al.

(10) Patent No.: US 7,745,386 B2
(45) Date of Patent: Jun. 29, 2010

(54) PROCESS OF INCORPORATING MICROCAPSULES INTO DRYER-ADDED FABRIC CARE ARTICLES

(75) Inventors: Darren Franklin King, West Chester, OH (US); Komal G. Patel, Cincinnati, OH (US); George Kavin Morgan, III, Hamilton, OH (US); Glenn Thomas Jordan, IV, Indian Springs, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/613,823

(22) Filed: Nov. 6, 2009

(65) Prior Publication Data

US 2010/0047463 A1 Feb. 25, 2010

Related U.S. Application Data

(63) Continuation of application No. 11/496,243, filed on Jul. 31, 2006, now Pat. No. 7,659,239.

(60) Provisional application No. 60/802,927, filed on May 24, 2006.

(51) Int. Cl.
*C11D 3/50* (2006.01)

(52) U.S. Cl. ..... 510/520

(58) Field of Classification Search ..... 510/520

See application file for complete search history.

(56) References Cited

U.S. PATENT DOCUMENTS

| | | | | |
|---|---|---|---|---|
| 5,246,603 | A | 9/1993 | Tsaur et al. | |
| 5,246,611 | A | 9/1993 | Trinh | |
| 5,425,887 | A | 6/1995 | Lam et al. | |
| 5,966,831 | A | 10/1999 | Anderson | |
| 6,352,969 | B2 | 3/2002 | Hsu et al. | |
| 2003/0045447 | A1 | 3/2003 | Heibel et al. | |
| 2003/0211125 | A1 | 11/2003 | Heltovics et al. | |
| 2005/0192207 | A1 | 9/2005 | Morgan, III et al. | |
| 2008/0014393 | A1 * | 1/2008 | Denome et al. | 428/35.7 |

FOREIGN PATENT DOCUMENTS

| | | | |
|---|---|---|---|
| GB | 1549432 | A | 8/1979 |
| WO | WO 2008/005693 | A2 * | 1/2008 |

OTHER PUBLICATIONS

International Search Report mailed Oct. 23, 2007, 4 pages.

* cited by examiner

*Primary Examiner*—John R Hardee
(74) *Attorney, Agent, or Firm*—Gary J. Foose; David U. Upite

(57) ABSTRACT

Dryer-added fabric conditioning articles that comprise friable perfume microcapsules provide consumers an impactful freshness experience while wearing clothing that is treated by the article. Manufacturing processes of incorporating friable perfume microcapsules into dryer-added articles that maximizes the yield of unruptured microcapsules are provided.

6 Claims, No Drawings

PROCESS OF INCORPORATING MICROCAPSULES INTO DRYER-ADDED FABRIC CARE ARTICLES

CROSS REFERENCE TO RELATED APPLICATIONS

This application is a Continuation of U.S. application Ser. No. 11/496,243, filed Jul. 31, 2006, now U.S. Pat. No. 7,659,239 which claims priority to U.S. Provisional Application Ser. No. 60/802,927, filed May 24, 2006.

FIELD OF INVENTION

The present invention relates to processes of incorporating microcapsules into dryer-added articles.

BACKGROUND OF THE INVENTION

Consumers are continually expressing the desire to have scent on their fabrics that lasts longer & throughout the entire day. Current fabric softeners, especially dryer sheets, fall short in fulfilling this consumer need. With the growing & evolving scent trends in today's market place, especially in candles & the air care category, consumers want volatile scent characters such as fruity, citrus, green, lighter florals, and the like on their fabrics. The issue is that the perfume ingredients that are needed to produce these character types do not readily deposit onto clothing because they are usually lost during the drying process given, inter alia, high temperatures.

Dryer sheets are a convenient vehicle for delivering freshness (via perfume) onto consumers' clothing. Long-lasting freshness (scent that lasts for several days) is particularly appealing to the dryer sheets consumer, and as a result of this, numerous ways to encapsulate perfume so as to increase its ability to last on clothing have been described. One suitable way includes the use of friable perfume microcapsules. However, a problem with friable perfume microcapsule, verses moisture activated microcapsules (e.g., cyclodextrin), is that traditional manufacturing approaches may likely lead to premature rupturing of the microcapsule thereby providing unacceptable yields in the manufacture of dryer added fabric care articles. There is a need to identify manufacturing processes suitable to incorporate friable microcapsules into dryer-added articles.

SUMMARY OF THE INVENTION

The present invention attempts to address these and other needs by providing, in a first aspect of the invention, a method of making a dryer-added fabric softening dryer sheet comprising the steps:(a) adding a microcapsule slurry, comprising a temperature from about 50° C. to about 100° C., to a coat mix thereby forming a composition comprising the fabric conditioning active and the friable perfume microcapsule; (b) applying the composition comprising the fabric conditioning active and the friable perfume microcapsule to a substrate.

Yet another aspect provides a method of making a fabric softening dryer sheet comprising the steps (a) adding a microcapsule slurry to a coat mix, wherein the coat mix has exited a coat mix tank thereby forming a composition comprising the fabric conditioning active and the friable perfume microcapsule, wherein the composition is at temperature from about 51° C. to about 100° C.; and (b) applying the composition to a substrate.

Yet another aspect provides a method of making a dryer sheet comprising the steps:(a) adding a first composition comprising a friable perfume microcapsule to a coat mix thereby forming a second composition that comprises the friable perfume microcapsule and coat mix, wherein the first composition comprises: (a) less than about 5% water by weight of the first composition; and (b) preferably from about 95% to about 100% of friable perfume microcapsule by weight of the first composition, wherein the microcapsule comprises a shell capsule; wherein the shell capsule comprises an aminoplast resin; wherein the microcapsule encapsulates a perfume composition; wherein the coat mix preferably comprises from about 90% to about 100% of a fabric conditioning active; (b) applying the second composition to a substrate.

Methods and kits using the articles of the present invention are also provided.

DETAILED DESCRIPTION OF THE INVENTION

Coat Mix and Coat Mix Tank

One aspect of the invention provides a coat mix and coat mix tank. The term "coat mix" means, for purposes of the present invention, a composition that comprises a fabric conditioning active. In one embodiment, the fabric conditioning active comprises a fabric softening active, wherein preferably the fabric softening active is suitable for use in an automatic laundry dryer. Non-limiting examples of fabric softening actives may include those described in U.S. Pat. No. 5,476,599 at col. 6, 1. 6 to col. 9, 1. 63; and U.S. Pat. No. 5,578,234 at col. 2, 1. 33 to col. 11, 1. 24. Dryer sheets containing fabric softener actives are generally described by U.S. Pat. Nos. 3,442,692; 3,686,025; 4,834,895; 5,041,230; 5,145,595; 5,470,492; 5,476,599; 5,883,069.

In one embodiment, the fabric conditioning active is a cationic nitrogen-containing compound such as quaternary ammonium compound having one or two straight-chain organic groups of at least 8 carbon atoms; preferably one or two such groups of from 12 to 22 carbon atoms and, alternatively ester and/or amide linked. Specific non-limiting examples of conditioning actives include the following: Di Tallow, Di Methyl Ammonium Methyl Sulfate, N,N-di(oleyi-oxy-ethyl)-N,N-dimethyl ammonium chloride, N,N-di (canolyl-oxy-ethyl)-N,N-dimethyl ammonium chloride, N,N-di(oleyl-oxy-ethyl)-N-methyl, N-(2-hydroxyethyl)ammonium methyl sulfate, N,N-di(canolyl-oxy-ethyl)-N-methyl, N-(2-hydroxyethyl)ammonium methyl sulfate-, N,N-di (oleylamidoethyl)-N-methyl, N-(2-hydroxyethyl) ammonium methyl sulfate-, N,N-di(2-oleyloxy oxo-ethyl)-N, N-dimethyl ammonium chloride, N,N-di(2-canolyloxy oxo-ethyl)-N,N-dimethyl ammonium chloride-, N,N-di(2-oleyloxyethylcarbonyloxyethyl)-N,N-dimethyl ammonium chloride, N,N-di(2-canolyloxyethylcarbonyloxyethyl)-N,N-dimethyl ammonium chloride; N-(2-oleyloxy ethyl)-N-(2-oleyloxy oxo-ethyl)-N,N-dimethyl ammonium chloride; N-(2-canolyloxy ethyl)-N-(2-canolyloxy oxo-ethyl)-N,N-dimethyl ammonium chloride, N,N,N-tri(oleyl-oxy-ethyl)-N-methyl ammonium chloride, N,N,N-tri(canolyi-oxy-ethyl)-N-methyl ammonium chloride-, N-(2-oleyloxy oxoethyl)-N-(oleyl)-N,N-dimethyl ammonium chloride, N-(2-canolyloxy oxoethyl)-N-(canolyl)-N,N-dimethyl ammonium chloride, 1,2-dioleyloxy N,N,N-trimethylammoniopropane chloride; and 5,2-dicanolyloxy N,N,N-trimethylammoniopropane chloride, and combinations thereof. In one embodiment, the fabric conditioning active is N,N-di(tallowyl-oxy-ethyl)-N-methyl, N-(2-hydroxyethyl)ammonium methyl sulfate.

In another embodiment, the fabric conditioning active includes ingredients such as a nonionic material. Suitable nonionic materials may include polyoxyalkylene glycols, higher fatty alcohol esters of polyoxyalkylene glycols, higher fatty alcohol esters of polyoxyalkylene glycols, ethoxylates of long chained alcohols of from 8 to 30 carbon atoms such as the ethoxylates of coconut, palm, tallow alcohols or hydrogenated alcohols with 4 to 40 moles of ethylene oxide, and alkanolamides. The fabric conditioning actives may further comprise (with or without a non-ionic material) fatty acids, ethoxylated fatty acids, and combinations thereof. Preferred fatty acids are those wherein the long chain is unsubstituted or substituted alkyl or alkenyl group of from about 8 to 30 carbon atoms. Examples of specific fatty acids are lauric, palmitic, stearic, oleic, and/or combinations thereof. The term fabric conditioning active may include other ingredients such as those described in U.S. Pat. No. 5,476,599 at col. 6, 1. 6 to col. 9, 1. 63; and U.S. Pat. No. 5,578,234 at col. 2, 1. 33 to col. 11, 1. 24.

The coat mix may also comprise from about 10% to about 30%, alternatively from about 15% to about 25% of an ethoxylated nonionic as a fabric conditioning active, by weight of the coat mix. The coat mix may also further comprise from about 5% to about 15% of a fatty acid as a fabric conditioning active, alternatively a $C_{15}$ to $C_{19}$ fatty acid, by weight of the coat mix.

In one embodiment, the coat mix comprises a low level of water. Adding too much water to a coat mix may cause the coat mix to solidify or gel. This will cause problems in the manufacturing process as the phase changed coat mix may clog pipes or no longer have desirable flow characteristics for processing. In one embodiment, the coat mix comprises less than about 10%, alternatively less than about 9%, or 8%, or 7%, or 6%, or 5%, or 4%, or 3%, or 2%, or 1%, or 0.5%, or about 0.1% of water by weight of the coat mix. Alternatively the coat mix may comprise at least about 0.001% water, by weight of the coat mix. Alternatively the coat mix is free or substantially free of water. The coat mix may comprise a moisture-activated perfume microcapsule such as one comprising cyclodextrin (e.g., beta-cyclodextrin for example at 4-15 wt % levels). In one embodiment, the coat mix is free or substantially free of a perfume microcapsule.

The term "coat mix tank" is used herein in the broadest sense to include any container capable of containing a commercial quantity of a coat mix, and preferably mix the coat mix on a commercial scale. A non-limiting example of a coat mix tank includes DCI Inc. 500 gallon Dynamixer. In one embodiment, the coat mix tank comprises a heating element. The term "heating element" is used herein the broadest sense to include any device that may impart heat to the coat mix contained within the coat mix tank. In another embodiment, the coat mix is at a heated temperature in the coat mix tank (i.e., the coat mix is heated while in the coat mix tank or delivered to the coat mix tank already in a heated form, or combination thereof). Non-limiting examples of a heating element may include: electric heat tracing in the jacket of the coat mix tank (e.g., there is an outer layer and inner layer to the coat mix tank and between these layers there is an electric tracing that is controlled via a computer). The temperature of the coat mix in the coat mix tank, in one embodiment, is from about 50° C. to about 125° C., alternatively from about 60° C. to about 105° C., alternatively from about 60° C. to about 100° C., alternatively from about 65° C. to about 95° C., alternatively from about 70° C. to about 90° C., alternatively from about 75° C. to about 85° C.

In one embodiment, the coat mix contained in the coat mix tank is free or substantially free of a friable microcapsule. In another embodiment, the coat mix contained in the coat mix tank comprises a moisture-activated microcapsule (e.g., wherein the shell of the microcapsule comprises cyclodextrin).

In one embodiment, the coat mix tank comprises one or more mixing elements. The term "mixing elements" is used herein the broadest sense and includes any means of mixing the coat mix in the coat mix tank on a commercial scale. Non-limiting examples of mixing elements includes a wall scraper, agitator, recycle pump, or combinations thereof. A wall scraper works by scraping, in a circular pattern, coat mix that has adhered to the wall of the coat mix tank. An agitator is located at the bottom of the coat mix tank. Much like a blender, an agitator rotates in a circular fashion such that the coat mix is not allowed to settle at the bottom of the coat mix tank. A recycle pump pushes the coat mix from the bottom of the vessel through piping and back into the top of the coat mix tank. Manufacturers of mixing elements include Chemineer Kinetics.

Microcapsule Slurry and Microcapsule Slurry Tank

One aspect of the invention comprises a microcapsule slurry, preferably wherein the microcapsule is a perfume microcapsule or preferably a friable perfume microcapsule, contained in a microcapsule slurry tank. In one embodiment, the slurry is heated within at least about ±30° C., alternatively ±20° C., alternatively ±10° C. of the temperature of the coat mix contained in the coat mix tank. For purposes of the this embodiment, the temperature of the coat mix is taken while the coat mix is contained within the coat mix tank, preferably at the time that the coat mix is sufficiently heated and mixed i.e., coat mix is ready to exit the coat mix tank for further processing.

Another aspect of the invention provides for the microcapsule slurry to be added to the molten coat mix subsequent to the coat mix exiting the coat mix tank for further processing. In this embodiment, the composition resulting from the coat mix combining with the microcapsule slurry has a temperature from about 50° C. to about 100° C., alternatively from about 55° C. to about 99° C., alternatively about 60° C. to about 98° C., alternatively at least from about 51° C., or 52° C., or 53° C., or 54° C., or 55° C., or 56° C., or 57° C., or 58° C., or at least about 59° C.

Yet another aspect of the invention provides the step of adding a microcapsule or perfume microcapsule (e.g., as a perfume microcapsule slurry, in a powdered form, or otherwise) to a substrate, preferably when the substrate is coated with a coat mix or a composition comprising the coat mix.

The term "microcapsule slurry tank" is used herein the broadest sense to include any container suitable for containing commercial quantities of a microcapsule slurry. The microcapsule slurry tank may comprise a heating element that imparts heat to the microcapsule slurry contained within the microcapsule slurry tank. The microcapsule slurry tank may also comprise a mixing element. Examples of heating elements and mixing elements include those previously described in the context of a coat mix tank.

The perfume microcapsules ("PMC") are preferably a friable PMC. "Friability" refers to the propensity of the microcapsules to rupture or break open when subjected to direct external pressures or shear forces. For purposes of the present invention, the microcapsules utilized are "friable" if, while attached to fabrics treated therewith, they can be ruptured by the forces encountered when the capsule-containing fabrics are manipulated by being worn or handled (thereby releasing the contents of the capsule). Friable perfume microcapsules are distinguished from moisture-activated microcapsules such as those microcapsules comprising mostly of cyclodextrin. The present invention is based, in part, on the observation that there is less PMC breakage if the friable PMC are added after a coat mix mixing step even if there are capital costs associated with such a step. These capital costs are more than off-set by the improved yield obtained in unruptured friable PMC delivered to the dryer-added article in the manufacturing of the dryer-added article. Although a preferred embodiment of the present invention is directed to perfume encapsulated within the friable microcapsule (thereby comprising a "friable perfume microcapsule" or a "friable PMC"), the present invention is not be limited to only those microcapsules encapsulating perfume. Rather, the friable microcapsules may encapsulate any active that is suitable to have on clothing. Non-limiting examples of such actives include skin care agents (such as aloe vera or skin moisturizer) or insect repellent (such as DEET).

Friable PMC are attractive for use in dryer-added articles because not only do the friable PMC enable top-note scent characters to deposit easily onto fabrics after the drying process, but also allows the consumer to experience these scent types throughout the day while wearing their article of clothing. Friable PMC rupture and release perfume by a mechanical means (e.g., friction)—not a chemical means (e.g., water hydrolysis). Minimal fracture pressure is typically needed to break the structure such as normal everyday physical movements such as taking off a jacket; pulling a shirt over your head; or taking off/putting on socks. Furthermore, friable PMC also allow the consumer to have a delightful scent experience on fabrics which have been in storage even for long durations of time due to their ability to protect perfume from volatilization to the surrounding air space.

In one embodiment, the microcapsule slurry is heated at least within about ±30° C., alternatively at least within about ±15° C., alternatively at least within about ±10° C. alternatively at least within about ±5° C., of the coat mix contained in the coat mix tank before the slurry is added to the coat mix exiting the coat mix tank. In one embodiment, the temperature of the microcapsule slurry is cooler than the temperature of the coat mix in the coat mix tank, but not less than a difference about 30° C. In another embodiment, the microcapsule slurry contained in the microcapsule slurry tank, just before its ready to be added to the coat mix exiting the coat mix tank, is at temperature from about 60° C. to about 95° C., alternatively from about 65° C. to about 90° C., alternatively from about 70° C. to about 90° C., alternatively from about 65° C. to about 85° C., alternatively from about 70° C. to about 85° C. The microcapsule slurry may be heated before the slurry is deposited into the microcapsule slurry tank, or heated while contained in the microcapsule slurry tank, or a combination thereof. This aspect of the invention is based, in part, on the observation that if the microcapsule slurry is not of sufficient elevated temperature and the rate of incorporation is significant enough, that when the slurry is incorporated into the coat mix (exiting from the coat mix tank), the coat mix temperature will be decreased such as to lead the coat mix: to solidify or gel (from its molten state); or have its viscosity raised sufficiently that further processing is inhibited.

Another aspect of the invention provides maintaining the temperature of the composition that comprises the coat mix and microcapsule slurry having a temperature from about 50° C. to about 125° C., alternatively from about 60° C. to about 105° C., alternatively from about 60° C. to about 100° C., alternatively from about 65° C. to about 95° C., alternatively from about 70° C. to about 90° C., alternatively from about 75° C. to about 85° C. Preferably the composition is a result of adding a microcapsule slurry to a coat mix subsequent to the coat mix exciting from the coat mix tank. Of course other embodiments are also contemplated such as, but not limited to, friable perfume microcapsules added in a powdered or granular form.

Another aspect of the invention provides for the amount of water in the microcapsule slurry to be minimized. In one embodiment, the microcapsule slurry comprises less than about 75% water, alternatively less than 50% water, alternatively less than 42% water, by weight of the microcapsule slurry. In another embodiment, the microcapsule slurry comprises from about 75% to about 20% water, alternatively from about 65% to about 30%, alternatively from about 60% to about 35%, alternatively from about 50% to about 38%, alternatively from about 45% to about 40%, by weight of the microcapsule slurry. In yet another embodiment, the microcapsule slurry comprises a friable perfume microcapsule and comprises at least 1%, but not greater than about 43%, alternatively no more than about 46%, alternatively no more than 50% water, by weight of the microcapsule slurry. In another embodiment, the microcapsule slurry comprising water is incorporated into the coat mix after the coat mix has exited the coat mix tank. This aspect of the invention is based, in part, on the observation that the microcapsule slurry (comprising water) should not be incorporated too quickly nor has such a high water content as to solidify or gel the coat mix. However, some water in the microcapsule slurry is desirable. Many suppliers of friable PMC provide the friable PMC as a friable PMC slurry comprising water (vs. a powder form). These friable PMC slurries are typically less expensive than powdered or dry forms of the same. Moreover, powdered forms of the friable PMC or those friable PMC slurries with high non-aqueous solvent levels may pose safety issues given the flammability associated with fine dust of the PMC and the flammability associated with some solvents, respectively. Water in the PMC slurry may also provide more uniform distribution of the PMC in the coat mix such as to avoid additional mixing steps such as ball mills and colloid mills. In one embodiment, the PMC is incorporated into the coat mix without or substantially without ball milling or colloid milling steps.

Yet another aspect of the invention provides for mixing the microcapsule slurry while the slurry is contained in the perfume slurry tank. Suitable ways of the mixing the slurry while in the perfume slurry tank include: a wall scraper, agitator, or combination thereof in the microcapsule slurry tank; or a static mixer in the pipe to or from the microcapsule slurry tank; or combinations thereof. Mixing by ball mills, colloid mills should preferably be avoided as to avoid breakage of the microcapsules. This aspect of the invention is based, in part, on the observation that mixing the PMC slurry provides more homogenous, uniform, incorporation of the microcapsule in the finished product.

Yet in another aspect of the invention, the microcapsule slurry comprises a structurant. While not being bound by theory, it is believed that the anionic materials that are sometimes part of the microcapsule slurry may adversely interact with the cationic surfactant actives that may be part of the coat mix. The interaction between anionic and cationic species may lead to aggregation or phase separation. In addition to the unacceptable aesthetics that results from aggregation of particles, such aggregates may result in rapid phase separation of the particles from the bulk phase. It is discovered that such aggregates may be prevented by the addition of structurants chosen from salts, polymers, or combinations thereof. Useful structurants may include: (1) divalent salts such as: magnesium salts, e.g., magnesium chloride, magnesium acetate, magnesium phosphate, magnesium formate, magnesium boride, magnesium titanate, magnesium sulfate heptahydrate; calcium salts, e.g., calcium chloride, calcium formate, calcium calcium acetate, calcium bromide; (2) trivalent salts such as: aluminum salts, e.g., aluminum sulfate, aluminum phosphate, aluminum chloride n-hydrate; and (3) polymers that have the ability to suspend anionic particles, such as soil suspension polymers, e.g., (polyethylene imines, alkoxylated polyethylene imines, polyquaternium-6 and polyquaternium-7).

In one aspect, calcium formate and/or formic acid may be added to a microcapsule slurry comprising water. Calcium formate and/or formic acid is typically combined with, based on total aqueous microcapsule slurry weight, at a level of from about 0.6% to about 3%, from about 1% to about 2%, alternatively from about 1.2% to about 1.5%, of the microcapsule slurry. An additional benefit with the use of calcium formate and/or formic acid may include microbial inhibition. Typically, the aforementioned microbial inhibition is achieved when the microcapsule slurry and/or the composition comprising the coat mix and microcapsule has a pH lower than about 4, preferably at or below about 3.8. Calcium Formate may be obtained from Perstorp Inc., of Toledo, Ohio U.S.A. and formic acid may be obtained from Aldrich, P.O. Box 2060, Milwaukee, Wis. 53201, USA.

In one embodiment, the structurant comprises from about 0.1% to about 5%, alternatively, 0.5% to about 4%, alternatively 0.6% to about 3%, by weight of the microcapsule slurry.

In one embodiment, the pH of the microcapsule slurry is acidic, preferably having a pH below about 6, alternatively below about 5.5, alternatively below about 4.5, alternatively below about 4, alternatively below about 3.7; alternatively from about pH of about 1 to about 6.

In one embodiment, the pH of the coat mix is acidic, preferably having a pH below about a pH below about 5, alternatively below about 4.5, alternatively below about 4, alternatively below about 3.8, alternatively below about 3.7; alternatively from about pH of about 1 to about 5.

Another aspect of the invention provides for a microcapsule slurry to comprise a formaldehyde scavenger. Further details of formaldehyde scavengers are described in U.S. patent application Ser. No. 11/351718, filed Feb. 10, 2006 (P&G Case 10301).

The flow of the coat mix, exiting from piping from the coat mix tank, in one embodiment, is pumped and can be regulated by a flow meter. The flow of the microcapsule slurry, exiting from piping from the microcapsule slurry tank, in one embodiment, is also pumped and can be regulated by a flow meter. In one embodiment, the coat mix and friable PMC slurry combine resulting in a composition that comprises from about 0.1% to about 10%, alternatively from about 0.5% to about 7%, alternatively from about 1% to about 6%, alternatively from about 1.5% to about 5%, alternatively from about 1.5% to about 4%, friable PMC by weight of the composition (wherein the composition comprises the coat mix and PMC). In another embodiment, the resulting composition (comprising the coat mix and PMC) comprises from about 80% to about 99.9%, alternatively from about 85% to about 99%, alternatively from about 87% to about 98%, alternatively from about 88% to about 97%, alternatively from about 89% to about 96%, of a fabric conditioning active by weight of the composition, preferably wherein the fabric conditioning active is a fabric softening active. In yet another embodiment, the resulting composition (comprising the coat mix and PMC) comprises from about 0.5% to about 9%, alternatively from about 1% to about 7%, alternatively from about 1.5% to about 6%, of a friable PMC, by weight of the composition.

In one embodiment, the coat mix comprises from about 95% to about 100%, alternatively from about 98% to about 99.9%, alternatively from about 99% to about 99.9%, of a fabric conditioning active, by weight of the coat mix. In yet another embodiment, the coat mix comprises from about 5% to about 0%, alternatively less than 4%, alternatively less than about 3%, alternatively less than about 2%, alternatively less than about 1%, alternatively less than about 0.5%, alternatively less than about 0.1%, alternatively substantially free, alternatively free, of water, by weight of the coat mix.

In one embodiment, the friable PMC slurry comprises 30% to about 60%, alternatively from about 35% to about 55% water, by weight of the slurry. In another embodiment, the friable PMC slurry comprises from about 30% to about 70%, alternatively from about 35% to about 65%, alternatively from about 37% to about 55% water, alternatively from about 38% to about 54%, alternatively from about 39% to about 52%, alternatively from about 40% to about 51%, of friable PMC, by weight of the slurry.

Less preferred, but within the scope of one aspect of the invention, is adding a composition of a friable PMC comprising a low amount of water (e.g., less than about 5% water by weight of the composition such as in a powdered or granular form of the friable PMC) to the coat mix. The substantially solid form of the friable PMC or low water composition containing PMC may be added anywhere in the manufacturing processes of the dryer sheet, including but not limited to the coat mix along the manufacturing processes including adding the friable PMC composition to the coat mix tank. Another process may include adding the composition "in-line" to the coat mix and thereafter static mixing. Yet another process may include spraying the PMC composition to dryer sheet, wherein preferably the dryer sheet comprises a hot coat mix and a non-woven substrate. The low water composition of the friable PMC may comprise less than about 5%, or 4%, or 3%, or 2%, or 1%, or 0.5%, or 0.1% water by weight of the composition. The lower water composition of the friable PMC may comprise from about 99.9% to about 1%, alternatively from about 80% to about 99%, alternatively from about 90% to about 99% of the friable PMC by weight of the composition. In yet another embodiment, the low water composition is free or substantially free of a fabric conditioning active. The composition comprising friable PMC and a low amount of water may be in a powder, or granular form.

Perfume Microcapsule

The microcapsules of the present invention are preferably perfume microcapsule, even more preferably friable perfume microcapsules. The term "perfume microcapsule" (or "PMC") is generally described in US 2003/215417 A1; US 2003/216488 A1; US 2003/158344 A1; US 2003/165692 A1; US 2004/071742 A1; US 2004/071746 A1; US 2004/072719 A1; US 2004/072720 A1; EP 1393706 A1; US 2003/203829 A1; US 2003/195133 A1; US 2004/087477 A1; US 2004/0106536 A1; U.S. Pat. Nos. 6,645,479; 6,200,949; 4,882,220; 4,917,920; 4,514,461; U.S. RE 32713; U.S. Pat. No. 4,234,627.

In one embodiment of the invention, the shell of the microcapsule comprises an aminoplast resin. A method for forming such shell capsules includes polycondensation. Aminoplast resins are the reaction products of one or more amines with one or more aldehydes, typically formaldehyde. Non-limiting examples of suitable amines include urea, thiourea, melamine and its derivates, benzoguanamine and acetoguanamine and combinations of amines. Suitable cross-linking agents (e.g., toluene diisocyanate, divinyl benzene, butane diol diacrylate etc.) may also be used and secondary wall polymers may also be used as appropriate, e.g. anhydrides and their derivatives, particularly polymers and co-polymers of maleic anhydride as disclosed in U.S. Pat. Publ. No. 2004/0087477 A1.

In another embodiment, the shell of the microcapsules comprises urea-formaldehyde; melamine-formaldehyde; or combinations thereof. In yet another embodiment, the shell capsules typically have a mean diameter in the range 1 micrometer to 100 micrometers, alternatively from 5 micrometers to 80 microns, alternatively from 10 micrometers to 75 micrometers, and alternatively between 15 micrometers to 50 micrometers. The particle size distribution can be narrow, broad or multimodal.

In another embodiment, microcapsules vary in size having a maximum diameter between about 5 microns and about 300 microns, alternatively between about 10 microns and about 200 microns. As the capsule particle size approaches 300 microns, e.g., 250 microns, a reduction in the number of capsules entrained in the fabric may be observed.

In another embodiment, the capsules utilized in the present invention generally have an average shell thickness ranging from about 0.1 micron to 50 microns, alternatively from about 1 micron to about 10 microns. Suppliers of microcapsules may include International Flavors & Fragrances (IFF), Reed Pacific, and Appleton. An example of a suitable microcapsule for purposes of the present invention includes "Perfume Microcapsules" from Appleton. Other examples may include "WIZARD" from Reed Pacific, and "EVERFRESH" from IFF. For a preferred embodiment, the shell is formed by cross-linking aldehydes and amine functionalities. In one embodiment, the encapsulated blooming perfume composition may, in one embodiment, comprise from about 3 to about 300 different perfume ingredients.

In one embodiment, the perfume microcapsule encapsulates a blooming perfume composition, wherein the blooming perfume composition comprises blooming perfume ingredients. Non-limiting examples of blooming perfume ingredients that may be useful in the articles of the present invention are given in U.S. Pat. Pub. No. 2005/0192207 A1, published Sep. 1, 2005, ¶¶29-31.

High Shear Mixing

One aspect of the invention provides subjecting a composition comprising the coat mix and the microcapsule to a high shear mixing, wherein the high shear mixing is free or substantially free of colloid-type milling. The composition is high shear mixed to increase homogeneity of the composition and allow such viscous materials (i.e., the coat mix and microcapsule slurry) to mix thoroughly as the high shear provides greater force in mixing. An example of a high sheer mixer is Greerco Pipeline Mixer 6" TSPLM 0-300 gpm. The term "colloid-type milling" means a mixing that subjects a composition to impact mixing such as colloid milling. This aspect of the invention is based, in part, on the observation that such "colloid-type milling" may burst the friable microcapsules prematurely thereby lowering the overall yield of delivering unruptured PMC in the final product. Non-limiting examples of colloid-type milling includes Greerco Colloid Mills Model W750 0-140 gpm.

Neat Perfume Addition

One aspect of the invention provides for the incorporation of neat perfume to the composition comprising the coat mix and microcapsules, alternatively after a high shear mixing step. In one embodiment, the neat perfume addition is applied after the coat mix is applied to the substrate, without wishing to bind by theory, to minimize the perfume from being volatized by avoiding prolonged contact with a hot coat mix or a hot composition comprising the coat mix. The term "neat perfume" means a composition comprising free perfume ingredients wherein the free perfume ingredients are neither absorbed onto or into a perfume carrier (e.g., absorbed on to zeolites or clays or cyclodextrins) nor encapsulated (e.g., in a perfume microcapsule). A free perfume ingredient may also comprise a pro-perfume (provided the pro-perfume is neither absorbed nor encapsulated). The neat perfume may be incorporated by adding it to the piping before the composition comprising the coat mix is added to the substrate (e.g., by impregnation). A static mixer may be used incorporate the neat perfume evenly into the composition comprising the coat mix. Alternatively, the neat perfume is coated on the substrate by spraying, wherein the substrate may or may not comprise a coat mix. The neat perfume may be incorporated by pumping using for example a Milton Roy metering pump M. Roy Series.

Static Mixer

One aspect of the invention provides for static mixing the composition comprising the coat mix and PMC, wherein preferably the composition comprises a neat perfume. Non-limiting examples of static mixtures include Kenics KM Static Mixers.

Optional Ingredients

The compositions of the present invention may contain effective amounts of optional ingredients, such as, but not limited to, a soil release agent, chelant, dye transfer inhibitor, dye fixative agent, chlorine scavenging agent, optical brightener, odor control agent, antimicrobial agent, fungicide, wrinkle control agent, anti-oxidant, preservative, plasticizer, insect repellent, moth repellent, processing aid, mold release agent, or combinations thereof. Examples of soil release polymers, chelants, dye transfer inhibitors, dye fixatives, chlorine scavengers, and anti-oxidants are given in U.S. Pat. No. 6,046,154, issued on Apr. 4, 2000 to Trinh et al. and references cited therein. In one embodiment, the dryer-added article comprises odor control agents (such as cyclodextrins, metal salts, and zeolites), wrinkle control agents, antimicrobial agents, fungicides, preservatives, insect repellents, or combinations thereof. In one embodiment, the composition is free or substantially free of one more of the above identified optional ingredients. In yet another embodiment, these optional ingredients may be encapsulated in the microcapsules of the present invention.

Delivering Coat Mix and Microcapsules to a Substrate.

One aspect of the invention provides for delivering a composition, comprising the coat mix and microcapsule, to a substrate. Suitable substrates may include those described in U.S. Pat. Pub. Nos. 5,470,492; 5,883,069; and 5,929,026. In one embodiment, the composition is coated to a substrate, such as a non-woven sheet, to form a dryer-sheet. The term "coated" is used herein the broadest sense to include any manner of incorporating the composition to a substrate including but not limited to layering, coating, impregnating, casting, or combinations thereof. Examples of dryer-added articles include those described in U.S. Pat. Nos. 4,000,340; 4,055,248; 4,073,996; 4,022,938; 4,764,289; 4,808,086; 4,103,047; 4,014,432; 3,701,202; 3,634,947; 3,633,538; 3,435,537; 6,604,297; and 6,787,510. An example of a non-woven dryer sheet is one from BBA Fiber Web. An example of machinery capable of such impregnation includes EDI—Ultracoat II® Slot Die Coating Head. In another embodiment, the composition is delivered to a mold wherein a substrate, wherein the substrate is in the form of a product carrier, is cast as part of the mold. Examples of such products may include those described in U.S. Pat. Pub. No. 2003/0192197

A1, published Oct. 16, 2003; or U.S. Pat. Pub. No. 2003/0195130 A1, published Oct. 16, 2003.

Delivering PMC to the Substrate

In an alternative aspect of the invention, a perfume microcapsule, neat perfume, or combination thereof, is added to a substrate, before or after the substrate is coated with a coat mix. The PMC may, in a preferred embodiment, be coated on to the substrate by spraying. The PMC, in this embodiment, may be sprayed as in a powder form or a PMC slurry form. A suitable sprayer may include a Nordson Corporation Spray/Powder Coater. Irrespective of how the microcapsule is incorporated into the manufacturing of a dryer-added article, in one embodiment, the amount of encapsulated perfume in the PMC is such that a single use dryer-added article comprises from about 10 mg to about 100 mg of encapsulated perfume. The amount of microcapsule will depend upon the loading level of the microcapsule and the efficiency of the article in delivering PMC to drying laundry (in an automatic laundry dryer). A typical efficiency of a dryer sheet, without limitation, in delivering encapsulated perfume to fabric during the laundry drying process is from about 70 to about 82% efficiency (by weight of encapsulated perfume).

Kits and Methods

One aspect of the invention provides for a kit comprising an article of the present invention, optionally comprising instructions, wherein preferably the instructions instruct the user to administer the article to an automatic laundry dryer, preferably a tumble dryer.

Another aspect of the invention provides for a method of treating fabric comprising the step of administering an article of the present invention into an automatic laundry dryer, preferably tumble dryer.

EXAMPLE 1

A friable perfume microcapsule slurry is added to coat mix after the coat mix exits the coat mix tank but before a high shear mixing step. Before being incorporated into the coat mix, the microcapsule slurry is contained in microcapsule slurry tank. The slurry is agitated and heated while being contained in the tank. The slurry contained in the tank is heated to a temperature of from about 60° C. to about 95° C. Before the microcapsule slurry is incorporated into the coat mix, the coat mix is first run through the piping to heat the pipes and "lubricate" the pipes for a few minutes (and then discarded) before the microcapsule slurry is pumped into the manufacturing pipes containing the coat mix. Upon the microcapsule slurry being added to the coat mix, the resulting composition is mixed in a high shear mixing step. After the high shear mixing step, the composition is sent through an impregnation head and coated onto a non-woven sheet.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

All documents cited in the DETAILED DESCRIPTION OF THE INVENTION are, in the relevant part, incorporated herein by reference; the citation of any document is not to be construed as an admission that it is prior art with respect to the present invention.

Except as otherwise noted, the articles "a," "an," and "the" mean "one or more."

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of making a dryer-added fabric conditioning, friable perfume microcapsule containing, dryer sheet comprising the steps:

(a) containing a coat mix in a coat mix tank, wherein the coat mix comprises a fabric conditioning active;

(b) applying the coat mix from the coat mix tank to a non-woven substrate to make a fabric conditioning dryer sheet;

(c) containing a microcapsule slurry at a temperature from about 50° C. to about 125° C. in a microcapsule slurry tank;

wherein the microcapsule slurry comprises a friable perfume microcapsule, and wherein the friable perfume microcapsule encapsulates a perfume composition; and wherein the microcapsule slurry comprises from about 20% to about 75% water, by weight of the microcapsule slurry; and (d) applying the microcapsule slurry from the microcapsule slurry tank to the fabric conditioning dryer sheet to make the dryer-added fabric conditioning, friable microcapsule containing, dryer sheet.

2. The method of claim 1, wherein the temperature of the microcapsule slurry, before the slurry is applied to the fabric conditioning dryer sheet, comprises a temperature from about 60° C. to about 95° C.

3. The method of claim 2, wherein the microcapsule slurry comprises from about 20% to about 60% water, by weight of the slurry.

4. The method of claim 3, wherein the coat mix, contained in the coat mix tank, further comprises:

(a) from about 95% to about 100% of the fabric conditioning active by weight of the coat mix;

(b) from about 0% to about 5% of water by weight of the coat mix; and (c) is substantially free of friable perfume microcapsules.

5. The method of claim 4, wherein the friable perfume microcapsule comprises a shell capsule, wherein the shell capsule comprises an aminoplast resin.

6. The method of claim 5, wherein the step of applying the microcapsule slurry from the microcapsule slurry tank to the fabric conditioning dryer sheet comprises using an impregnation head.

* * * * *